United States Patent [19]

Shaffer

[11] 4,068,441

[45] Jan. 17, 1978

[54] CUT GLASS PANEL

[75] Inventor: B. Jeremiah Shaffer, Worthington, Ohio

[73] Assignee: Pease Company, Fairfield, Ohio

[21] Appl. No.: 575,419

[22] Filed: May 7, 1975

[51] Int. Cl.[2] ..... E04B 5/46

[52] U.S. Cl. ..... 52/308; 52/315

[58] Field of Search ..... 52/306, 307, 308, 315, 52/390–392; 428/38, 67

[56] References Cited

U.S. PATENT DOCUMENTS

| | | | |
|---|---|---|---|
| 504,506 | 9/1893 | Verhaghen | 428/38 |
| 827,464 | 7/1906 | Pedrick | 52/307 |
| 904,594 | 11/1908 | Archer | 428/67 |
| 1,769,000 | 7/1930 | Smith | 428/67 |
| 2,169,720 | 8/1939 | Cederquist | 52/390 |
| 2,991,213 | 7/1961 | Williams | 52/308 |
| 3,070,474 | 12/1962 | Smith | 428/38 |
| 3,460,303 | 8/1961 | Algrain | 52/308 |

FOREIGN PATENT DOCUMENTS

| | | | |
|---|---|---|---|
| 399,830 | 7/1909 | France | 52/308 |
| 12,472 of | 1893 | United Kingdom | 52/306 |

*Primary Examiner*—Price C. Faw, Jr.
*Assistant Examiner*—Henry E. Raduazo
*Attorney, Agent, or Firm*—Biebel, French & Nauman

[57] ABSTRACT

A cut glass panel is formed of a plurality of pieces of glass bonded together to have at least one decorative side exposed to view. The periphery of the panel eventually will be encompassed in a frame in a window, door, or the like. The edges of the cut pieces of glass are arranged in a pattern such that the adjacent edge of one is approximately a mirror image of the adjacent piece and as a result the spacing between the pieces will be substantially of uniform width. The decorative side of each piece of glass will be beveled at its peripheral edges to provide a distinctive visual appearance. The cut pieces of glass are bonded together by material deposited in the space between the pieces of glass to form generally a T-shaped configuration in cross-section. The deposited material is a mixture of epoxy resin and inorganic filler with the filler having a coefficient of thermal expansion closely approximating that of the glass pieces bonded together.

1 Claim, 4 Drawing Figures

CUT GLASS PANEL

BACKGROUND OF THE INVENTION

Leaded cut glass windows are no longer made to any great extent due to the limited market and the cost of labor. However, a recent market has developed due to the exclusivity of the product. As a consequence, it became desirable to find some less expensive means for manufacturing the product. Experiments demonstrated that a simulated product would be more suitable for modern construction and this invention is directed to the resulting simulated leaded cut glass window.

The expensive hand cutting and beveling of glass to get the proper distinctive appearance with the various reflecting facets at the different angles of the ground or beveled glass planes and the difficulty of uniform and air tight attachment of preformed zinc or lead cames as well as the time involved in manufacturing the "leaded" cut glass window all contribute to the production problems. By way of illustration, the patent to Lillethun, U.S. Pat. No. 3,226,903 issued Jan. 4, 1966 has provided metallic cames prefabricated to hold pieces of colored glass in an insulated stained glass window structure. In 1970 the patent to Ferron et al., U.S. Pat. No. 3,512,320, disclosed a modification using cames of flexible resilient plastic material; again the cames being preformed in a generally H-shaped configuration. The esthetic effect in both cases is disappointing. Preforming the cames gives the window an appearance lacking in authenticity; consequently the products do not sell readily.

The structure described herein has solved this problem by beveling the edges of the glass pieces and bonding them together with a suitably colored epoxy resin and filler mixture which gives the appearance of an authentic antique leaded cut glass window, superior holding features and improved performance in providing an air impermeable glass panel.

DESCRIPTION OF THE PREFERRED EMBODIMENTS

Figure 1:
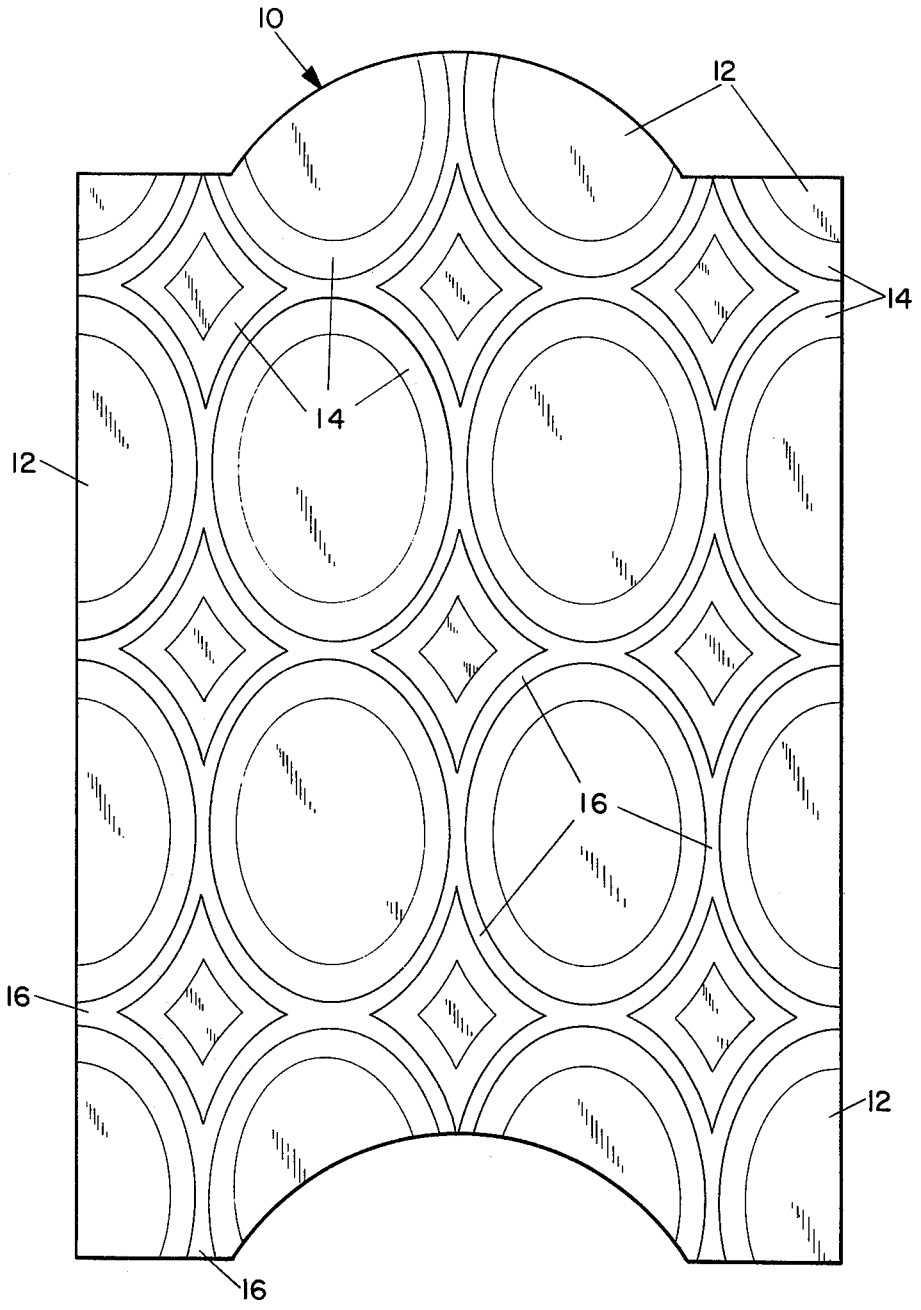
FIG. 1 is an elevational view of an illustrative cut glass panel manufactured according to the instant invention.

FIG. 1 illustrates a glass panel 10 including a plurality of pieces of glass 12 beveled at 14 along their edges and bonded together by a bead of epoxy resin 16. The actual shape of the individual pieces of glass is immaterial to this invention except that the edges of adjacent pieces are cut such that the two facing edges are approximately mirror images of each other, such that the spacing between the adjacent pieces is approximately of uniform width throughout the common boundary.

Figure 2:
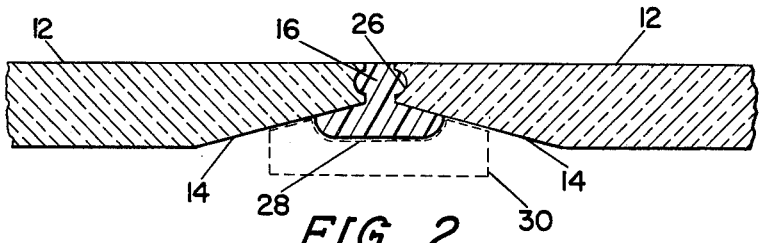
FIG. 2 is a fragmentary sectional view of one of the bonded joints between two cut pieces of glass in the panel of FIG. 1.

FIG. 2 illustrates the edges of two pieces of glass 12 having bevels 14 along their edges and bonded together by the bead of epoxy resin 16 having a generally T-shaped configuration in cross-section.

The adhesive itself is a two component resin as follows:

| Component A | Parts by Weight |
|---|---|
| Dow Epoxy Resin 331 | 22.67 |
| Celanese Epoxy Resin 505 | 9.72 |
| Calcium Carbonate (Camdwhite) | 64.27 |
| Pigment Dispersion White | 0.54 |
| Pigment Dispersion Black | 2.80 |
| Component B | |
| Polyamide AZ450 | |

Gray pigment may be added as needed to give the desired lead color but other pigments of different color could be added if desired.

The indicated components may be mixed with appropriate filler prior to combining. The Dow epoxy (a condensation of epichloridrin-phenol A) and the Celanese epoxy as mixed work to give early strength but not such complete polymerization as to make the batch prematurely hard upon the addition of the polyamide (liquid nylon-accelerated amido-amine).

Component B is mixed with Component A in a ratio of ten parts Component A with one and one-half parts of Component B, the proportions being weight ratios.

The thermosetting organic resins are standard adhesive components purchased from manufacturers in bulk and mixed as needed. The fillers are added at the work site, the filler being mixed in proper proportions with the components prior to the time the components are combined.

In operation, pieces of glass (alkaline earth silicate or the like) are cut to shape by a commercially available pattern cutter and while others may be available, one manufactured by Bilco Manufacturing, Inc., Zelieonepel, Pennsylvania, Type AIRSOS is used. The piece is cut from a flat pane of glass in a conventional manner by forming a series of score lines on one side of the glass and then breaking the glass at the score lines. As is well known in the glass art, when the score line 18 (see FIG. 3) is made it produces small jagged irregularities 20 on the score line side of the glass, called "scores". These jagged irregularities form stress concentration points and possible beginnings for cracks for the glass should it be put under stress. The opposite side of the glass, called the breakline side of the glass 22, has a sharp edge without the scores of the opposite side, as a general rule. Following breaking into the desired pattern the glass piece is "edged", that is, the corners are rounded, as at 24 in FIG. 3, to eliminate sharp edges and scores which might be stress concentration points.

In this invention, one side of the glass is modified by forming a chamfer or bevel at an angle of about 5–17° and preferably the width of the bevel is about 5/8 inch. The width of the bevel will partially be governed by the thickness of the glass. It is intended that the beveling operation grind away not more than about one-half the thickness of the glass; the bevel is illustrated in phantom in FIG. 3 at 25.

During the course of experiementation with various adhesives for bonding the glass piece together, the particular epoxy adhesives currently used were tested by thermal cycling and a plurality of different recipes were tried. The recipes ranged from the pure (two component) materials supplied by the manufacturer, the pure materials with various ingredients for their thixotropic properties, hardeners, softeners, etc. None was found to be satisfactory until the materials mixed to form Components A and B as indicated above were used in combination with varying amounts of filler material, which filler material had approximately the same coefficient of thermal expansion as the glass panes themselves. Filler materials used satisfactorily are the ground glass itself, magnesium oxide, and limestone of particle size ranging from 0.1–1000$\mu$. Why this is true is unknown. Logically the coefficient of thermal expansion of the epoxy should control. But, the fillers listed make the adhesive effective for long life where, without the particular fillers the useful life is much shorter. For example, using the pure epoxy and cycling between about 20° and 150° F., the bonding material cracked at about 30–35 cycles. However, using the indicated fillers there was no cracking at 65 cycles. Obviously, the severe thermal cycling used during the testing is unlikely ever to occur but the superior results achieved with the fillers are certainly dramatic and unexpected.

The coefficients of thermal expansion of the useful fillers are listed below, it is believed that the coefficient of thermal expansion of the fillers is critical but it is not known why this is so.

| Goods | Coefficient of Thermal Expansion |
|---|---|
| Glass | $10.7 \times 10^{-6}$ per degree centigrade |
| Magnesium Oxide | $9.7 - 11.4 \times 10^{-6}$ per degree centigrade |
| Limestone | $9.0 \times 10^{-6}$ per degree centigrade |

After the glass pane is scored, broken, tempered and edged, the pieces are beveled or chamfered as needed by a diamond grinding wheel. The pieces having edges forming part of the periphery of the resulting glass panel need not be beveled. However, all other surfaces which will be juxtaposed to other beveled glass edges will be beveled. The edges of glass panes which are part of the periphery of the glass panel will be rounded or "edged" in conventional manner to prevent the sharp glass edges from cutting the hands of those handling the glass panel. All the interior edges of the glass panes will be beveled in the preferred embodiment although unbeveled antique glass or the like may be substituted, and with the designated resin joint material, the panel still will be sound structurally.

Figure 3:
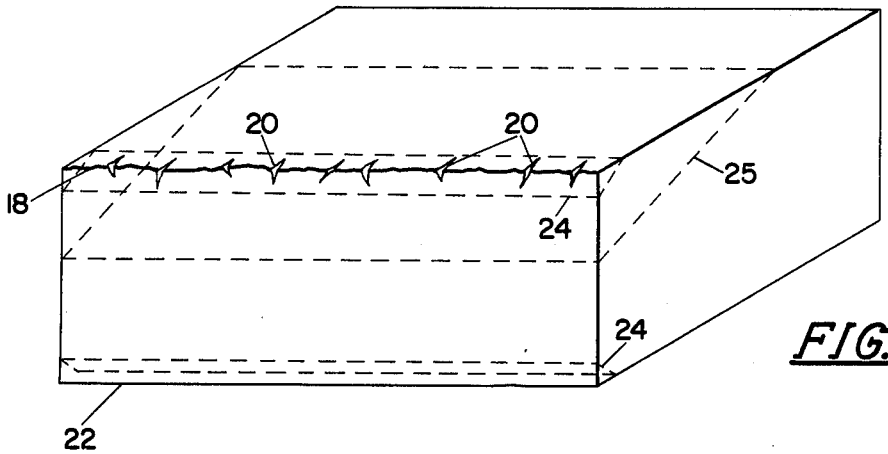
FIG. 3 is an elevational view of the edge of a piece of glass broken along its score line with the side of the glass where it was scored facing upward, the anticipated "edging" lines are shown in phantom and the scores and irregularities are greatly exaggerated merely for illustrative purposes.

The bevel is shown in phantom at 25 in FIG. 3 and after the beveling is completed, the beveled surface will be cloudy or frosted in appearance. This must be buffed away or in some way reformed to provide the kind of brilliant "high light" desirable; it may be done on conventional felt buffing apparatus well known to those in the glass industry and no description appears necessary.

However, it has been discovered that if the glass pieces are washed and tempered (at 1350°–1375° F) prior to buffing on a felt wheel, the buffing time is reduced about 25% with a resulting reduced cost in labor and buffing materials. Accordingly, tempering is a part of the preferred process at a time prior to buffing.

It is well known that glass is not a crystaline solid but is a supercooled liquid. At about 1750° F a piece of glass will be a red flexible flowable mass like taffy. It is presumed that at the tempering temperature the glass "flows" a bit and seals small crevices and rounds jagged peaks.

After appropriate buffing of the tempered glass panes, they are placed in a mold having the desired outline of the resulting panel. The cut pieces are placed in a predesignated pattern within the mold.

After the glass panes are polished and before they are mounted in the mold, the edges to be bonded to other glass edges are given a structurally irregular surface by "frosting" and in some cases they are "penciled" as illustrated at 26 in FIG. 2, whereby a groove is cut into the edge to be bonded to provide a better locking and holding mechanism for the adhesive. Certainly, almost any roughening mechanism would fall within the scope of this inventive concept.

After frosting, the glass pieces are placed in a mold or jig with the beveled surface facing down and with the spacing between the edges of the pieces being about ⅛ to 3/16 inches. They are locked in place by vacuum and/or mechanical locking levers which press the pieces down into place on top of the mold. The mold itself includes a small groove 28 illustrated in phantom located immediately beneath the space between the pieces of glass. Into this mold cavity 28 is injected the mixed epoxy resin 16 which forms the bead of T-shaped cross-section illustrated generally in FIG. 2. The mold 30 beneath the glass pieces 12 forming the mold cavity 28 is preferably of silicone rubber because of its lack of reaction with the epoxy adhesive and its resistance to heat.

In the preferred embodiment each individual piece of glass is secured in the jig by one or more vacuum loaded suction cups (not shown). It is important that the glass pieces 12 not move during the time the resin is being deposited nor during the resin curing period for obvious reasons.

Figure 4:
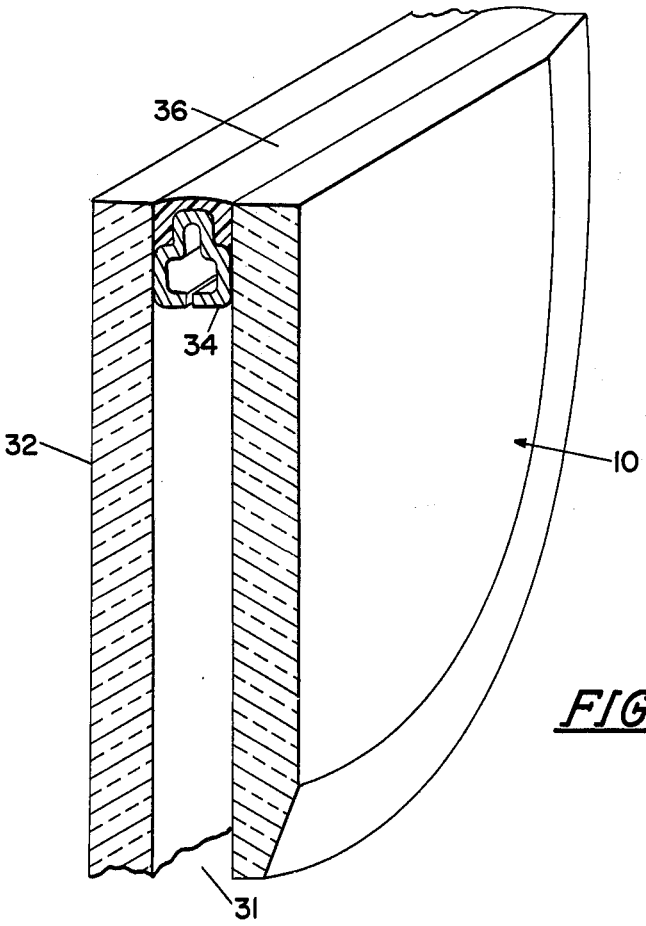
FIG. 4 is a fragmentary sectional view showing the cut glass panel as the outer facing of an insulated window.

After the resin is in all cracks or gaps between the glass pieces, the upper exposed bead of resin on the reverse side of the panel from its decorative side is trimmed off to provide a planar construction surface, and infrared heat lamps are directed against the panel for about 15–30 minutes. The heating time needed for curing is dependent upon the temperature of the panel. For example, with the panel at about 200° F. curing is adequate in about 15 minutes and at about 150° F. curing is adequate in about 30 minutes. The glass panel may then be washed and if desired sandwiched with a clean, clear or colored, or patterned pane to form an insulated unit separated by a dead air space 31 as illustrated schematically in FIG. 4. The decorative panel 10 is shown on the right-hand side and the other panel 32 is shown on the left-hand side. The spacer 34 is conventional in design and used in most insulated windows on the market today. The bonding adhesive 36 at this edge is a two component polysulfide used conventionally and is well-known in the art. No description of this appears necessary.

Modifications will be obvious to those having ordinary skill in the art and it is not intended that the invention be limited by the terminology of the specification nor the drawings illustrating the same. Rather, it is intended that the invention be limited only by the scope of the appended claims.

I claim:

1. A decorative self-supporting cut glass panel adapted to be mounted with its periphery encompassed in a frame in a window, door, or the like, comprising, in combination, a. a plurality of pieces of light-transmitting sheet glass bonded together in coplanar relation forming a self-supporting and light-transmitting panel having a decorative side and a reverse side, b. the peripheral edges of each of said glass pieces which are adjacent others of said pieces in said panel being cut to approximately the mirror image of said adjacent pieces and being arranged with spaces of approximately uniform width between adjacent said pieces, c. adhesive material filling said spaces between adjacent said pieces of glass, d. said adhesive being a mixture of organic materials and inorganic filler, e. said filler having a coefficient of thermal expansion closely approximating that of said glass pieces and being selected from the group consisting of finely ground glass, magnesium oxide and calcium carbonate, f. said mixture of organic materials comprising an epoxy resin and a curing agent, g. said adjacent edges of said glass pieces being beveled on said decorative side of said panel, h. said bevel being at an angle in the range of 5° to 17° from the plane of said decorative side of said panel and having a width of the order of $\frac{5}{8}$ inch, i. the edges of said glass pieces facing each other having structurally irregular surfaces providing better bonding engagement with said adhesive material, j. said adhesive material extending through said panel between adjacent pieces of glass and having a generally T-shaped cross-section including a head portion overlying the adjacent surface portions of said bevels but retained within the plane of said decorative surface, and k. the end of said T-shaped section opposite said head portion being flush with said reverse side of said panel.

* * * * *